US006665886B1

(12) United States Patent
Chu

(10) Patent No.: US 6,665,886 B1
(45) Date of Patent: Dec. 23, 2003

(54) TOILET SEAT

(76) Inventor: Ping Chu, 4Fl., No. 17, Alley 7, Lane 90, Fushiang Rd., Junghe City, Taipei (TW), 235

( * ) Notice: Subject to any disclaimer, the term of this patent is extended or adjusted under 35 U.S.C. 154(b) by 0 days.

(21) Appl. No.: 10/279,822

(22) Filed: Oct. 25, 2002

(51) Int. Cl.[7] ..... A47K 13/00
(52) U.S. Cl. ..... 4/237
(58) Field of Search ..... 4/234, 237, 253

(56) References Cited

U.S. PATENT DOCUMENTS 2,427,953 A * 9/1947 Fishko ..... 607/82
2,575,208 A * 11/1951 Calderon ..... 4/237
4,181,988 A * 1/1980 Skaggs ..... 4/237

* cited by examiner

*Primary Examiner*—Charles E. Phillips
(74) *Attorney, Agent, or Firm*—Bacon & Thomas, PLLC

(57) ABSTRACT

A toilet seat includes an upper and a lower seat for a predetermined number of sets of restoring mechanism, transmission mechanism, and shielding panel to mount between them. When the upper seat is subjected to a downward force, the restoring mechanism is compressed and the transmission mechanism Is caused to move the shielding panel horizontally from a closed position closing a central opening of the toilet seat to an opened position opening the central opening. And when the toilet seat is not in use, a restoring force of the compressed restoring mechanism pushes the upper seat and the transmission mechanism upward, and the shielding panel is brought by the transmission mechanism to move from the opened position to the closed position again.

7 Claims, 6 Drawing Sheets

PRIOR ART FIG.1

PRIOR ART FIG.2

TOILET SEAT

FIELD OF THE INVENTION

The present invention relates to a toilet seat, and more particularly to a toilet seat provided with restoring and transmission mechanisms to move a set of shielding panels between a closed and an opened position to close or open a central opening of the toilet seat.

BACKGROUND OF THE INVENTION

FIGS. 1 and 2 are exploded and assembled perspective views, respectively, of a conventional flush toilet 1 that includes a toilet bowl 2 and a toilet seat 12 and a toilet seat lid 11 pivotally connected to a rear side of the toilet bowl 2. The toilet seat lid 11 is provided at a rear side with two holes 111 adapted to receive two shafts 121 sideward projected from a rear side of the toilet seat 12, so that the lid 11 is pivotally connected to the toilet seat 12 to cover the latter.

After the lid 11 and the toilet seat 12 are assembled together through engagement of the holes 111 with the shafts 121, they are further connected to the toilet bowl 2.

When a male user wants to relieve himself, he would usually lift the lid 11 and the toilet seat 12 first. However, there are times some male users do not lift the toilet seat 12 before relieving themselves and therefore smudge the toilet seat 12.

Another problem with the conventional toilet seat 12 is it is possible for some people to carelessly drop some item into the toilet bowl 2 via a central opening of the toilet seat 12 when the lid 11 is not closed onto the toilet seat 12.

It is therefore desirable to develop an improved toilet seat to eliminate the drawbacks existed in the conventional toilet seat.

SUMMARY OF THE INVENTION

A primary object of the present invention is to provide a toilet seat that would automatically remind a male user to lift it before relieving himself.

Another object of the present invention is to provide a toilet seat that prevents foreign matters from undesirably dropping into the toilet bowl.

To achieve the above and other objects, the toilet seat of the present invention includes an upper and a lower seat for a predetermined number of sets of restoring mechanism, transmission mechanism, and shielding panel to mount between them. When the upper seat is subjected to a downward force, the restoring mechanism is compressed and the transmission mechanism is caused to move the shielding panel horizontally from a closed position closing the central opening of the toilet seat to an opened position opening the central opening. And when the toilet seat is not in use, a restoring force of the compressed restoring mechanism pushes the upper seat and the transmission mechanism upward, and the shielding panel is brought by the transmission mechanism to move from the opened position to the closed position again.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 5A is an enlarged view of the encircled area of FIG. 5;

FIG. 5B is a partially enlarged view showing the state of an elastic element included in the toilet seat when the shielding panels are in the closed position;

FIG. 6A is an enlarged view of the encircled area of FIG. 6; and

FIG. 6B is a partially enlarged view showing the elastic element included in the toilet seat is compressed when the shielding panels are in the opened position;

DETAILED DESCRIPTION OF THE PREFERRED EMBODIMENTS

Figure 1:
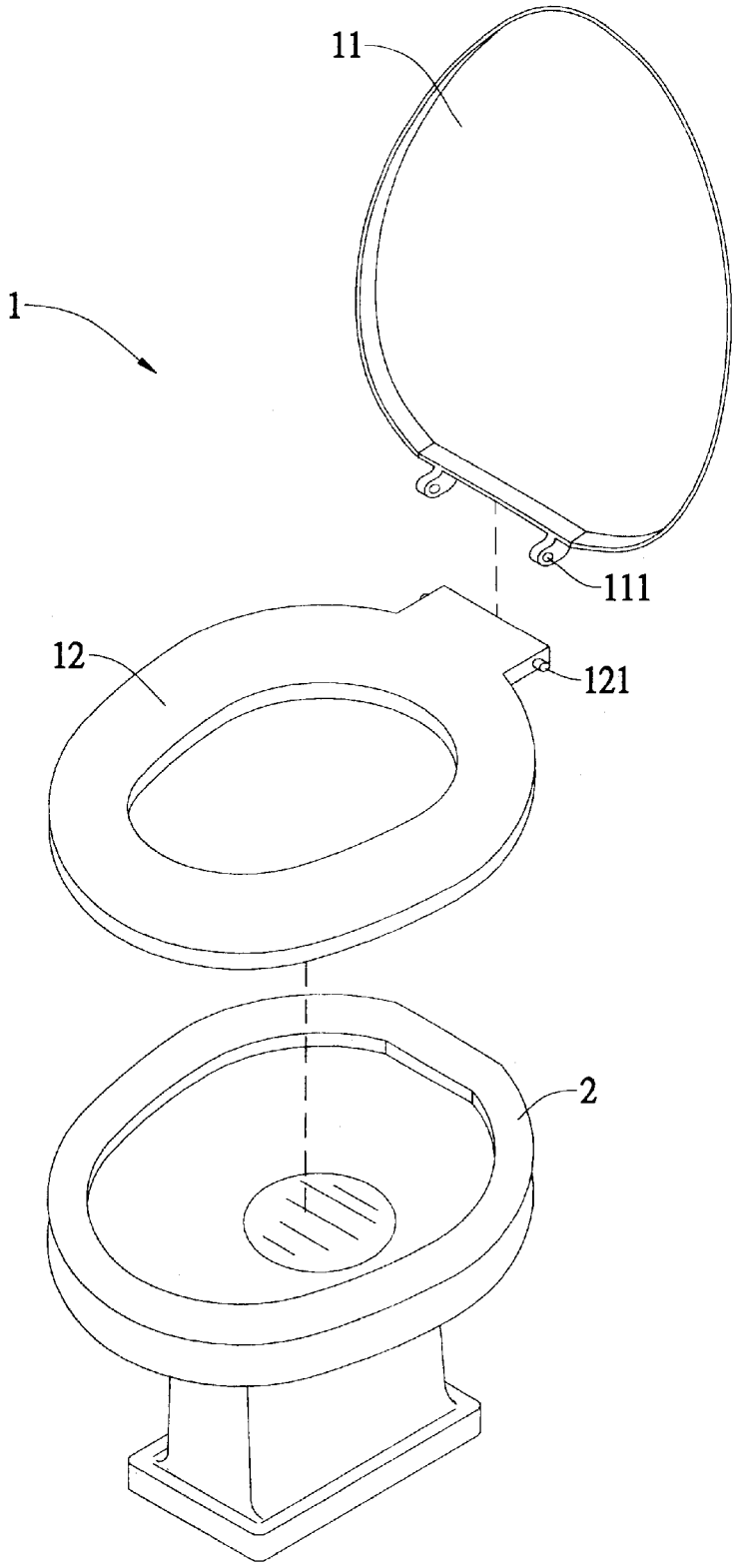
FIG. 1 is an exploded perspective view of a conventional flush toilet having a conventional toilet seat.
Figure 2:
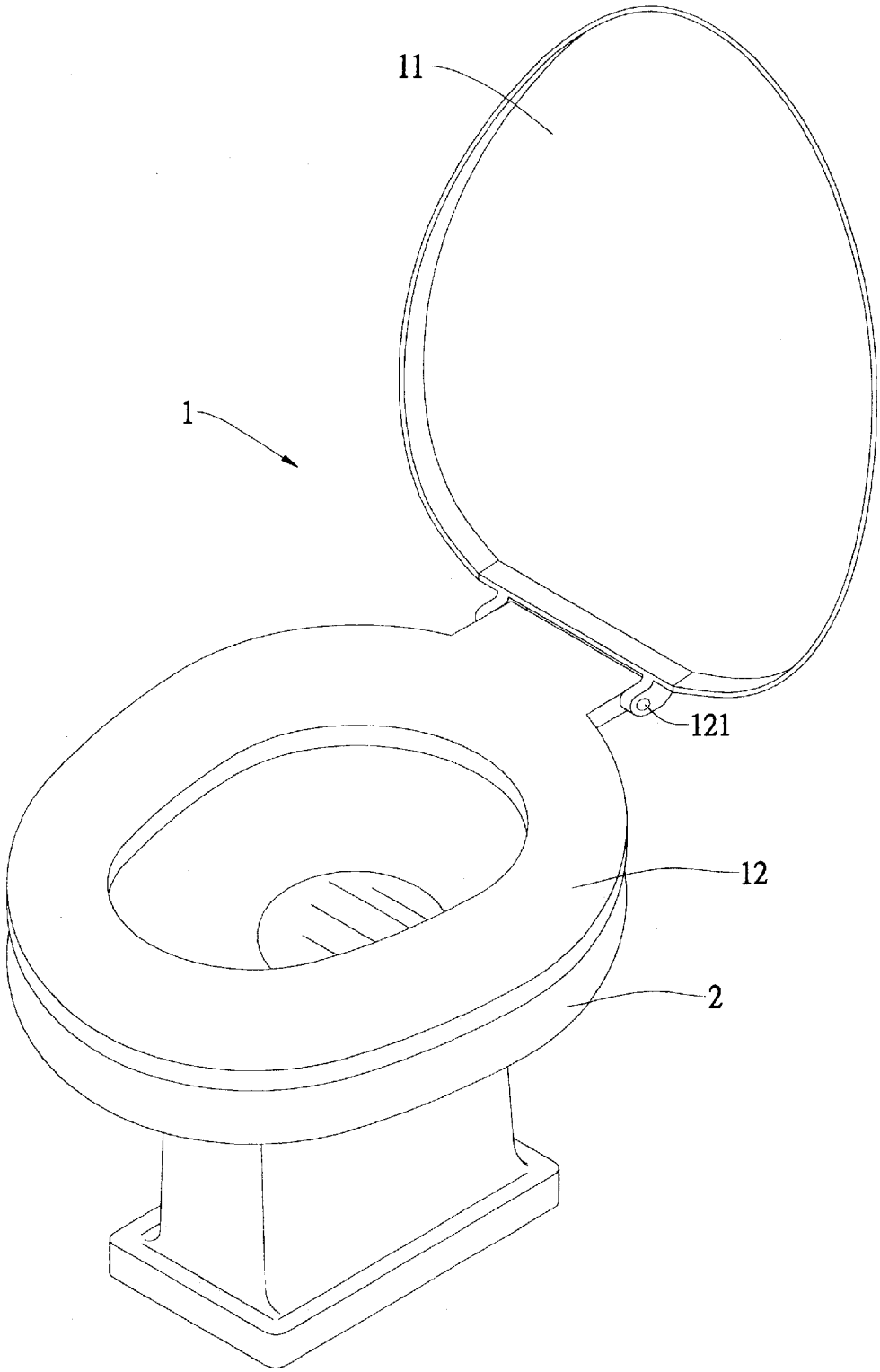
FIG. 2 is an assembled perspective view of FIG. 1.
Figure 3:
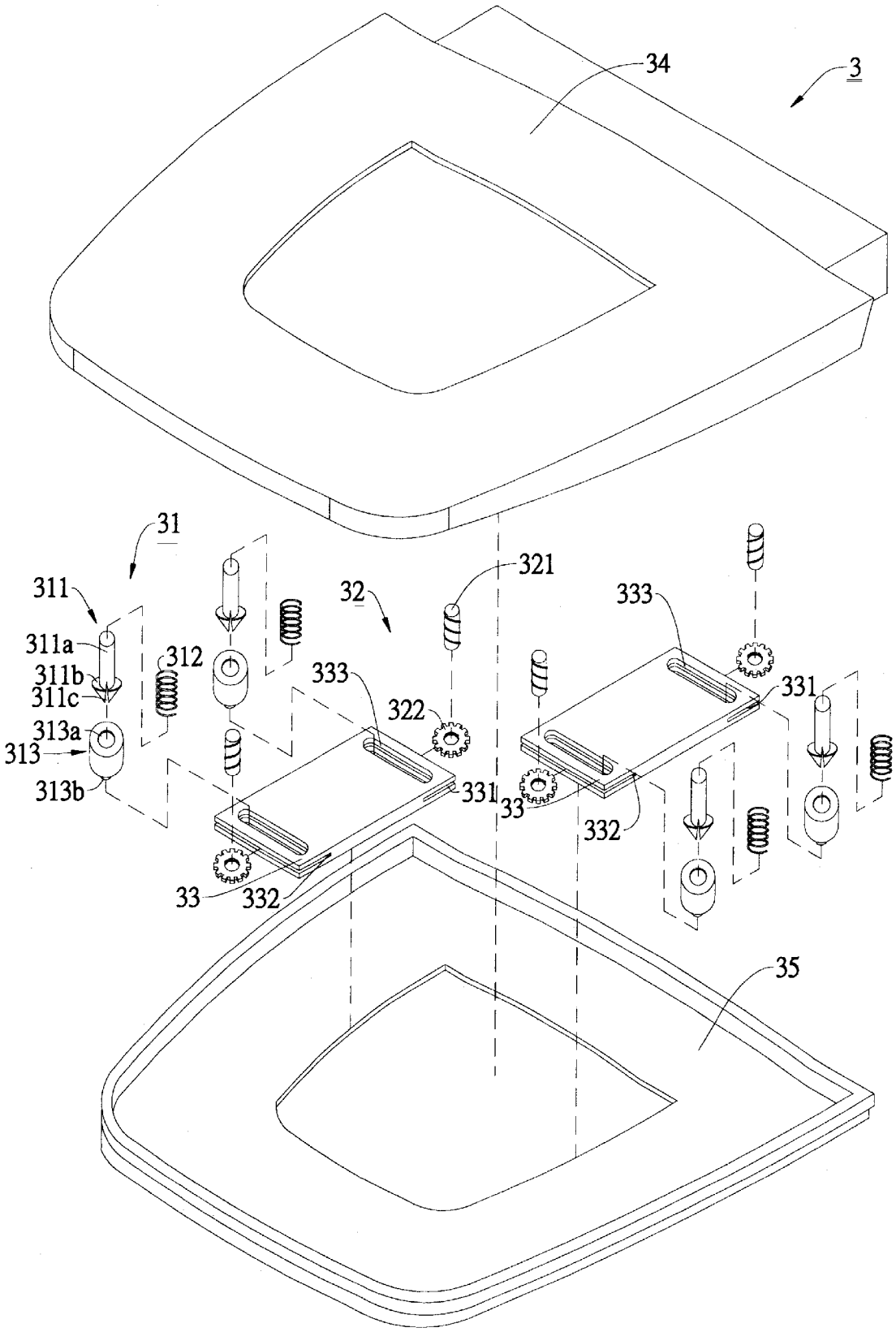
FIG. 3 is an exploded perspective view of a toilet seat according to the present invention.
Figure 4:
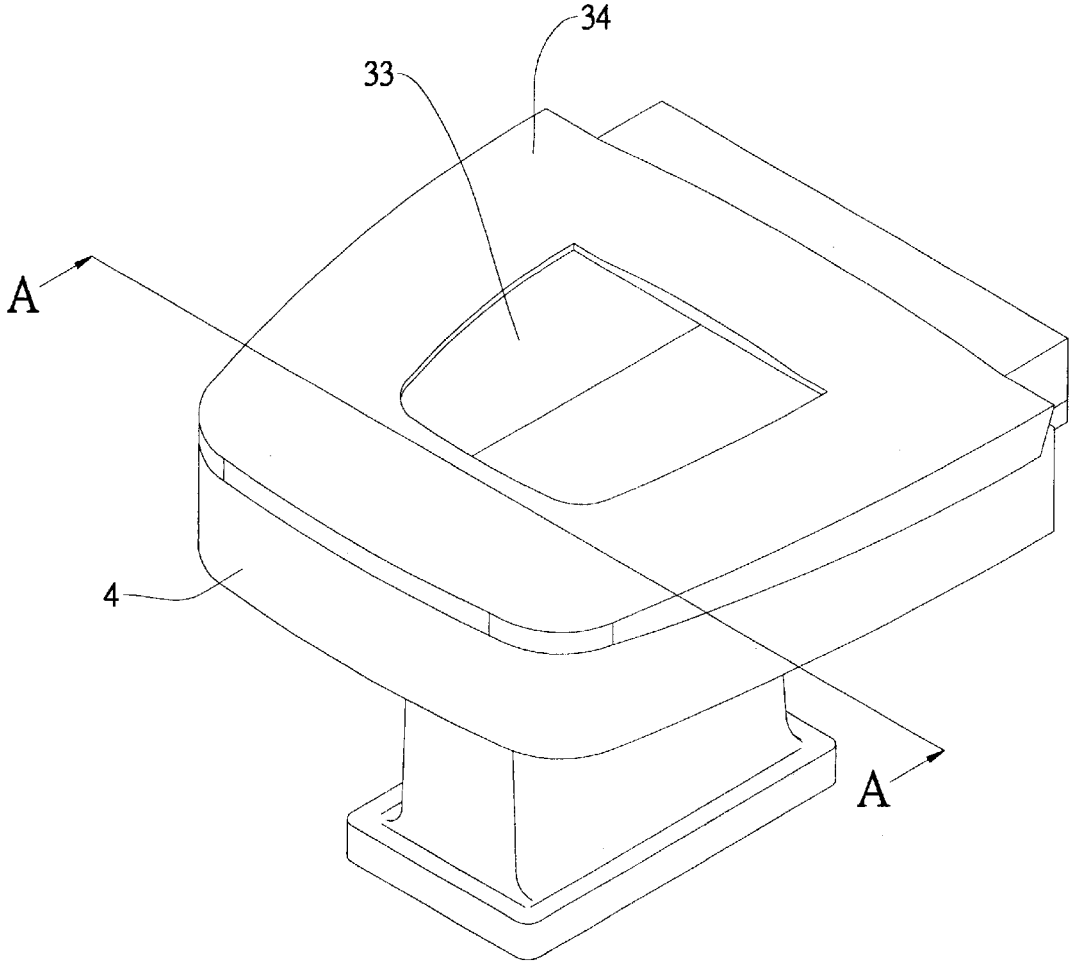
FIG. 4 is an assembled perspective view of FIG. 3.
Figure 5:
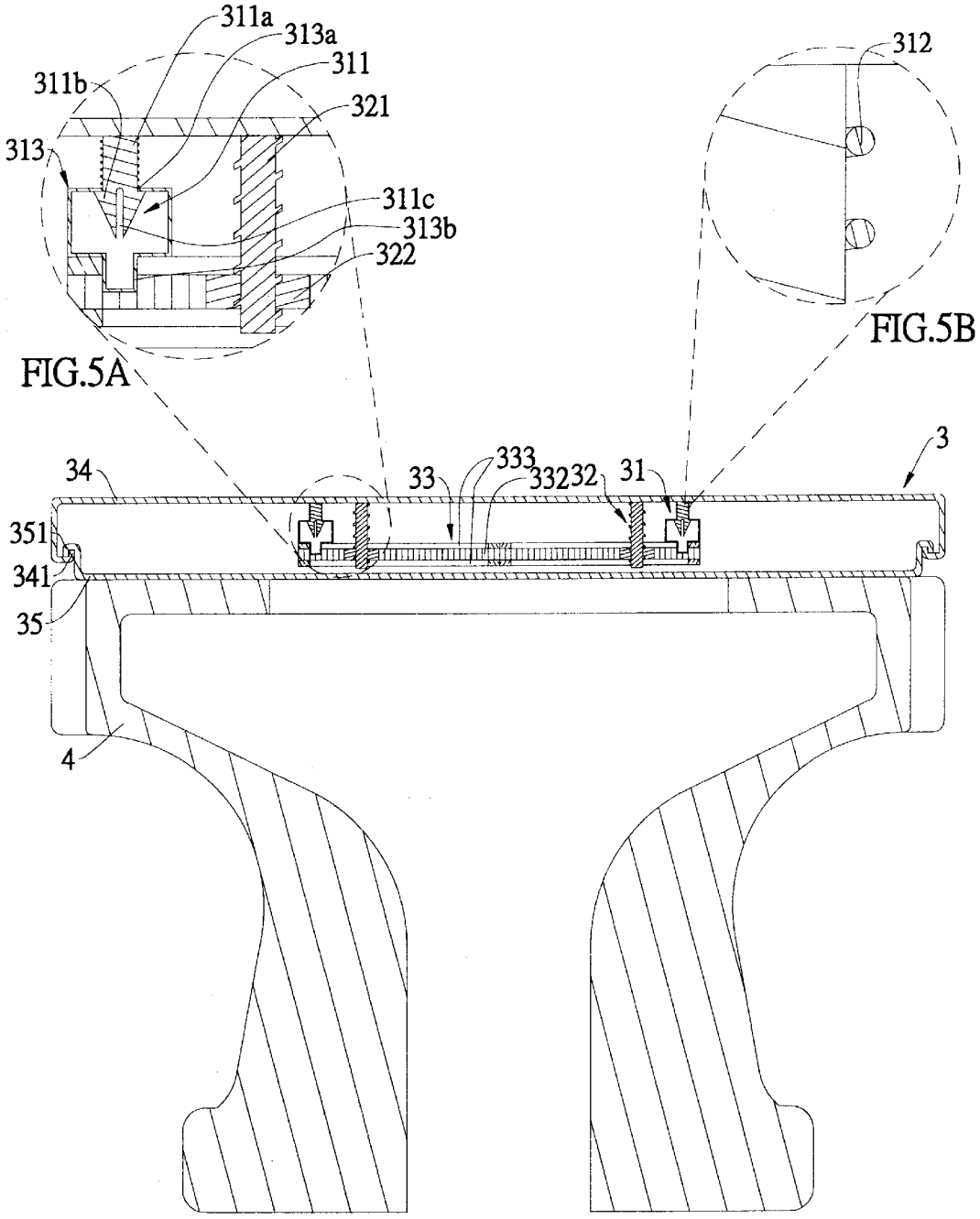
FIG. 5 is a sectional view taken along line A—A of FIG. 4 with shielding panels included in the toilet seat in a closed position.
Figure 6:
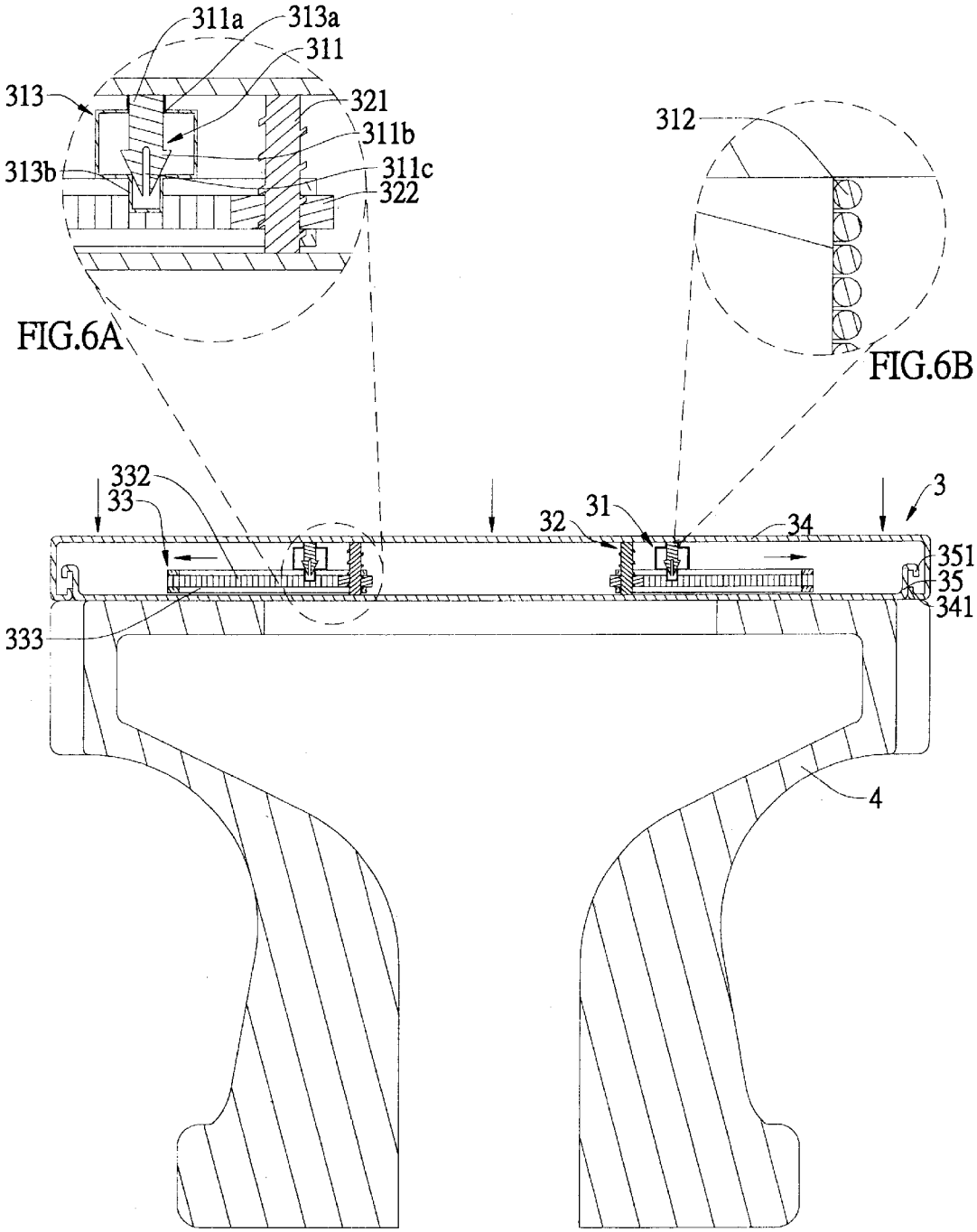
FIG. 6 is a sectional view taken along line A—A of FIG. 4 showing the shielding panels are moving to an opened position.

Please refer to FIGS. 3 and 4 that are exploded and assembled perspective views, respectively, of a toilet seat 3 according to the present invention, and to FIGS. 5 and 6 that are sectional views taken along line A—A of FIG. 4. As shown, the toilet seat 3 includes an upper seat 34 and a lower seat 35, and is provided between the upper and the lower seat 34, 35 at predetermined positions with two shielding panels 33, with which restoring mechanisms 31 and transmission mechanisms 32 are associated for the shielding panels 33 to move between a closed position, in which the shielding panels 33 close a central opening defined by the toilet seat 3, and an opened position, in which the shielding panels 33 open the central opening of the toilet seat 3.

As can be most clearly seen from FIG. 3, the restoring mechanism 31 includes a locating rod 311 connected at an upper end to a lower side of the upper seat 34, an elastic element 312 mounted around the locating rod 311, and a sleeve 313 vertically movably receiving a lower end of the locating rod 311 therein. More specifically, the locating rod 311 includes an upper shaft portion 311*a* and a lower engaging portion 311*b*. The lower engaging portion 311 is a conic body having a transversely extended central slit 311*c*; and the sleeve 313 includes a hole 313*a* defined at an upper end thereof, and a pivotal pin portion 313*b* downward projected from a lower end thereof.

FIG. 3 also shows that the transmission mechanism 32 includes a transmission element 321 having trapezoidal external threads provided thereon and being connected at an upper end to the lower side of the upper seat 34, and a gear 322 mounted on the transmission element 321 and having trapezoidal internal threads provided thereon to mesh with the trapezoidal external threads of the transmission element 321, such that the gear 322 is vertically movable on and relative to the transmission element 321.

The shielding panel 33 is provided at two opposite ends with a horizontally extended recess 331 each, in which a rack 332 is mounted to mesh with the gear 322. The shielding panel 33 is also provided near the two opposite ends immediately above the two recesses 331 with a slide slot 333 each. The slide slot 333 is vertically communicable with the recess 331 and extends almost a full width of the shielding panel 33.

The upper seat 34 of the toilet seat 3 is provided along a lower peripheral edge with a first hooking rim 341, and the lower seat 34 is provided along an upper peripheral edge with a second hooking rim 351 adapted to engage with the first hooking rim 341 and thereby connect the upper seat 34 to the lower seat 35 to provide the whole toilet seat 3 an esthetic appearance.

To assemble the restoring mechanism 31 to the toilet seat 3, first put the elastic element 312 around the shaft portion 311*a* of the locating rod 311, and then take advantage of the slit 311*c* to force the engaging portion 311*b* of the locating rod 311 into the hole 313*a* at the upper end of the sleeve 313. Thereafter, connect the upper end of the locating rod 311 to the lower side of the upper seat 34 at a predetermined position, and extend the pivotal pin portion 313*b* at the lower end of the sleeve 313 into the slide slot 333 on the shielding panel 33. Meanwhile, allow the transmission element 321 of the transmission mechanism 32, which has been connected at the upper end to the lower side of the upper seat 34 beforehand, to extend a lower end through the slide slot 333 and the gear 322 that has been pre-positioned in the recess 331 below the slide slot 333. Through meshing of the trapezoidal external threads of the transmission element 321 with the trapezoidal internal threads of the gear 322, the gear 322 is held in the recess 331 of the shielding panel 33 to mesh with the rack 332 mounted in the recess 331. Repeat the above steps to assemble other restoring mechanisms 31, transmission mechanisms 32, and shielding panels 33 to the lower side of the upper seat 34. Finally, the lower seat 35 of the toilet seat 3 is connected to the upper seat 34 through engagement of the second hooking rim 351 with the first hooking rim 341.

FIG. 5 shows the shielding panels 33 assembled to the lower side of the upper seat 34 are normally located at a closed position to shield a central opening of the toilet seat 3. A male user has to lift the toilet seat 3 with the closed central opening before he can relieve himself. Thus, It is possible to always keep the toilet seat 3 clean and sanitary for use. FIG. 5A is an enlarged view of he encircled area of FIG. 5 to better show the positions of the restoring and the transmission mechanisms 31, 32 relative to the shielding panel 33 when the latter is in the closed position. And, FIG. 5B is an enlarged view showing the position of the elastic element 312 relative to the locating rod 311 when the shielding panel 33 is in the closed position.

On the other hand, FIG. 6 shows the shielding panels 33 in an opened position to open the central opening of the toilet seat 3. When a user sits on the toilet seat 3, the upper seat 34 is subjected to a downward force to move downward relative to the lower seat 35. At this point, the locating rods 311 connected to the lower side of the upper seat 34 are also lowered to extend deeper into the sleeves 313, as can be better seen from an enlarged view in FIG. 6A, and the elastic elements 312 put around the shaft portions 311*a* of the locating rods 311 are compressed between the upper seat 34 and the sleeves 313, as can be clearly seen from an enlarged view in FIG. 6B. Meanwhile, the transmission elements 321 connected to the lower side of the upper seat 34 also lower along with the downward moved upper seat 34. At this point, the gears 322 meshed with the transmission elements 321 are caused to rotate while moving upward along the transmission elements 321. Since the gears 322 are located in the horizontal recesses 331 of the shielding panels 33 to mesh with the racks 332 mounted in the recesses 331, the gears 322 push the racks 332 forward when they rotate and move upward on the transmission elements 321, and accordingly bring the shielding panels 33 to move outward and upward relative to the central opening of the toilet seat 3 under guiding of the slide slots 333. The shielding panels 33 are therefore finally opened.

When the toilet seat 3 is not in use, the upper seat 34 is not subjected to the downward force and is pushed upward by a restoring force of the compressed elastic elements 312 of the restoring mechanisms 31. The restoring force of the compressed elastic elements 312 also acts on the sleeve 313 to therefore move the shielding panels 33 downward by a certain distance. At this point, the gears 322 meshed with the rack 332 mounted in the horizontal recesses 331 of the shielding panels 33 are brought by the downward moved shielding panels 33 to lower. Due to the mutually meshed trapezoidal external and internal threads on the transmission elements 321 and the gears 322, respectively, the gears 322 rotate while they are lowering. Moreover, since the gears 322 mesh with the racks 332, the rotation and the downward movement of the gears 322 brings the shielding panels 33 to move inward and downward relative to the central opening of the toilet seat 3 under guiding of the slide slots 333. The shielding panels 33 are gradually moved to finally close the central opening of the toilet seat 3, as shown in FIG. 5.

With the shielding panels 33 normally closing the central opening of the toilet seat 3, the risk of having any item carelessly dropped into a toilet bowl 4 below the toilet seat 3 can be avoided. Moreover, with the shielding panels 33 provided on the toilet seat 3, it is possible to omit the conventional toilet seat lid 11 from the toilet seat 3.

It is noted that the shielding panels 33 for the above-described toilet seat 3 are not limited to two in number and may be increased or decreased. However, it is most preferable that the shielding panels 33 are at least two in number.

The present invention has been described with a preferred embodiment thereof and it is understood that many changes and modifications in the described embodiment can be carried out without departing from the scope and the spirit of the invention as defined by the appended claims.

What is claimed is:

1. A toilet seat, comprising a predetermined number of sets of restoring mechanisms transmission mechanisms, and shielding panels mounted below said toilet seat at predetermined locations to normally close a central opening of said toilet seat with said shielding panels; said shielding panels being separately associated with said transmission mechanisms in such a manner that when said toilet seat is subjected to a downward force to compress said restoring mechanisms and lower said transmission mechanisms, said shielding panels are brought by said transmission mechanisms to move outward relative to said central opening of said toilet seat to finally open said central opening; and that when said toilet seat is not in use, a restoring force of said restoring mechanisms in the compressed state pushes said toilet seat and said transmission mechanisms upward and accordingly brings said shielding panels to move inward relative to said central opening of said toilet seat to finally close said central opening of said toilet seat.

2. The toilet seat as claimed in claim 1, wherein each of said restoring mechanisms includes a locating rod being connected at an upper end to a lower side of said toilet seat, an elastic element being put on said locating rod, and a sleeve for receiving a lower end of said locating rod therein.

3. The toilet seat as claimed in claim 1, wherein each of said transmission mechanisms includes a transmission element being connected at an upper end to the lower side of said toilet seat, and a gear mounted around said transmission element; and wherein each of said shielding panels is provided at two opposite ends with a horizontal recess each, in which a rack is mounted to mesh with one said gears.

4. The toilet seat as claimed in claim 3, wherein each of said transmission elements is provided with trapezoidal external threads, and each of said gears is provided with trapezoidal internal threads to mesh with said trapezoidal external threads on said transmission element, whereby said gear is movable upward and downward along said transmission element while rotating relative to said transmission element.

5. The toilet seat as claimed in claim 1, wherein said toilet seat includes an upper and a lower seat.

6. The toilet seat as claimed in claim 5, wherein said upper seat is provided along a lower peripheral edge with a first hooking rim, and said lower seat is provided along an upper peripheral edge with a second hooking rim adapted to engage with said first hooking rim of said upper seat.

7. The toilet seat as claimed in claim 1, wherein said shielding panels are at least two in number.

* * * * *